US010773145B2

(12) United States Patent
Gardner

(10) Patent No.: US 10,773,145 B2
(45) Date of Patent: Sep. 15, 2020

(54) GOLF PUTTING TRAINING AID

(71) Applicant: Kayden Gardner, Richfield, UT (US)

(72) Inventor: Kayden Gardner, Richfield, UT (US)

(73) Assignee: Kayden Gardner, Richfield, UT (US)

( * ) Notice: Subject to any disclaimer, the term of this patent is extended or adjusted under 35 U.S.C. 154(b) by 0 days.

(21) Appl. No.: 16/201,431

(22) Filed: Nov. 27, 2018

(65) Prior Publication Data

US 2020/0164260 A1 May 28, 2020

(51) Int. Cl.
*A63B 69/36* (2006.01)
*A63B 102/32* (2015.01)

(52) U.S. Cl.
CPC ..... *A63B 69/3685* (2013.01); *A63B 2102/32* (2015.10)

(58) Field of Classification Search
CPC ..... A63B 69/3685; A63B 2102/32
See application file for complete search history.

(56) References Cited

U.S. PATENT DOCUMENTS 1,937,828 A * 12/1933 MacDonald ..... A63B 47/02 294/19.2
1,994,207 A 3/1935 Ahles
2,057,821 A 10/1936 Costello
2,157,415 A 5/1939 Jones
2,465,124 A 3/1949 Quattrin
2,743,930 A 5/1956 Jacuzzi
2,856,190 A 10/1958 Quattrin
4,085,936 A 4/1978 Patterson
D402,724 S 12/1998 Minami
6,431,992 B1 8/2002 Moody
6,435,975 B2 8/2002 Middleton
6,702,688 B2 3/2004 Hale
6,863,617 B2 3/2005 Park
7,431,659 B2 10/2008 Williams et al.
7,458,899 B2 12/2008 Michaud
7,686,702 B2 3/2010 Hubley
D631,523 S 1/2011 Pingalore
8,162,773 B1 4/2012 Pingalore
8,632,415 B1 1/2014 Smith
8,956,239 B2 2/2015 Parks
2004/0063511 A1* 4/2004 Middleton ..... A63B 53/0487 473/231
2009/0194552 A1* 8/2009 Jeremias ..... A63B 47/002 221/14
2018/0015348 A1 1/2018 Filmalter

* cited by examiner

*Primary Examiner* — Jeffrey S Vanderveen
(74) *Attorney, Agent, or Firm* — Thorpe, North & Western, LLP

(57) ABSTRACT

A golf putting training aid teaches a golfer to push the golf ball on the green during putting. The aid comprises a collar is carried by a golf club shaft. A bore extends vertically through the collar to receive a golf ball therein. The bore has a bottom opening facing downwardly. A flap is carried by the collar and extends into the bore and is displaceable to selectively retain and release the golf ball. An automatic ground actuated trigger is coupled to the flap and extending downwardly and rearward to contact the ground during fore swing of the golf club shaft to gravity release the golf ball onto the green and allow the golfer to push the golf ball with the golf club.

20 Claims, 6 Drawing Sheets

GOLF PUTTING TRAINING AID

BACKGROUND

Golf is a popular sport played by many people. Some aspects of golf, such as putting, can be frustrating to master. Putting can require a golfer to tap the golf ball with an appropriate force and direction towards the hole or cup. Golfers often strike the ball too hard or too soft. Improving putting is an ongoing effort for many golfers.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
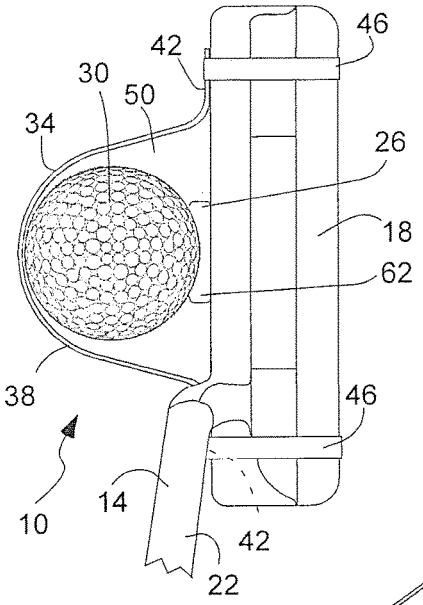
FIG. 1 is a top schematic view of a golf putting training aid in accordance with an embodiment of the invention, shown with a golf ball retained in the aid.

Reference will now be made to the exemplary embodiments illustrated, and specific language will be used herein to describe the same. It will nevertheless be understood that no limitation of the scope of the invention is thereby intended.

DETAILED DESCRIPTION

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

The term "putter" is used herein to refer to a golf club used to make relatively short and low-speed strokes, or puts, with the intention of rolling the ball relatively short distances to the hole or cup. The putter can have a club head carried by a distal end of a shaft, and a grip on an opposite proximal end of the shaft. The putter is different than other clubs, such as the irons or woods. The putter can have a club head with a flat, vertically oriented and relatively low striking face. As used herein, the putter can include both blade or mallet type putters, unless otherwise specified.

An initial overview of the inventive concepts are provided below and then specific examples are described in further detail later. This initial summary is intended to aid readers in understanding the examples more quickly, but is not intended to identify key features or essential features of the examples, nor is it intended to limit the scope of the claimed subject matter.

The invention presents a method and device to train a golfer to improve putting. Putting can be a source of great frustration to golfers. Putting can require a golfer to tap the golf ball with an appropriate force and direction towards the hole or cup. Golfers often strike the ball too hard or too soft. The present method teaches the golfer to push the ball with the head of the putter towards the hole, rather than to strike the ball. For shorter distance puts, the club head of the putter can be placed against the ball, and then the golfer can push the ball towards the hole or cup, without a back swing.

For longer distance puts, the present device provides a golf putting training aid. The aid is carried by a shaft of a golf club or putter. In one aspect, the aid can be affixed to an existing putter. In another aspect, the aid can be carried by its own shaft, and can define its own club. The aid has a pocket or bore to hold the golf ball, and a bottom opening through which the ball can be released. Thus, the putter can be swung back and forward, or through a back swing and a fore swing, with the ball retained by the aid on the putter.

A flap can selectively retain the ball in the bore, and can selectively release the ball through the bottom opening. An automatic ground actuated trigger can be coupled to the flap and can extend below the aid and the putter. When the aid and the putter are adjacent the ground or green during the fore swing, the trigger makes contact with the ground and releases the flap to automatically release the ball from the bore onto the green in front of a push surface of the aid or the putter head so that golfer can push the ball along the green through the remainder of the fore swing. Thus, the aid allows the ball to be carried by the putter via the aid through the back swing and an initial portion of the fore swing, like a natural golf swing, while also allowing the ball to be selectively released in front of the putter head to be pushed by the putter head through a later portion of the fore swing. The golfer is thus trained to think about putting as pushing rather than striking. The aid can be utilized on a practice putting green. The automatic ground actuated trigger can release the ball automatically, and without the golfer needing to think about releasing the ball or taking any action to release the ball. In addition, the automatic ground actuated trigger can simply release the ball, providing a gravity release, without imparting any other force or direction to the ball that would interfere with the golfer's training.

Figure 2A:
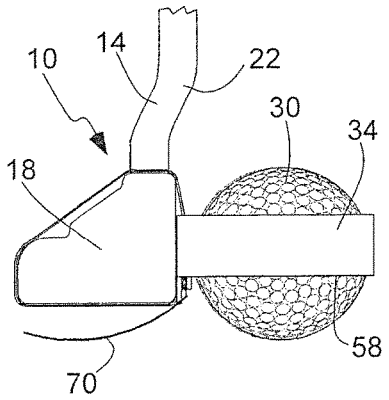
FIG. 2*a* is a side schematic view of the golf putting training aid of FIG. 1, shown with the gold ball retained in the aid.
Figure 2B:
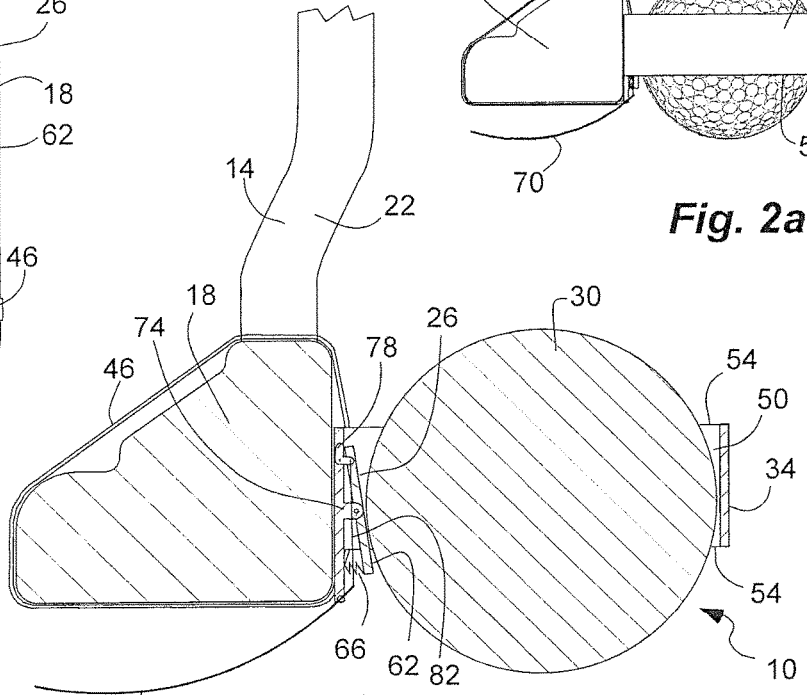
FIG. 2*b* is a cross-sectional side schematic view of the golf putting training aid of FIG. 1, shown with the gold ball retained in the aid.
Figure 3:
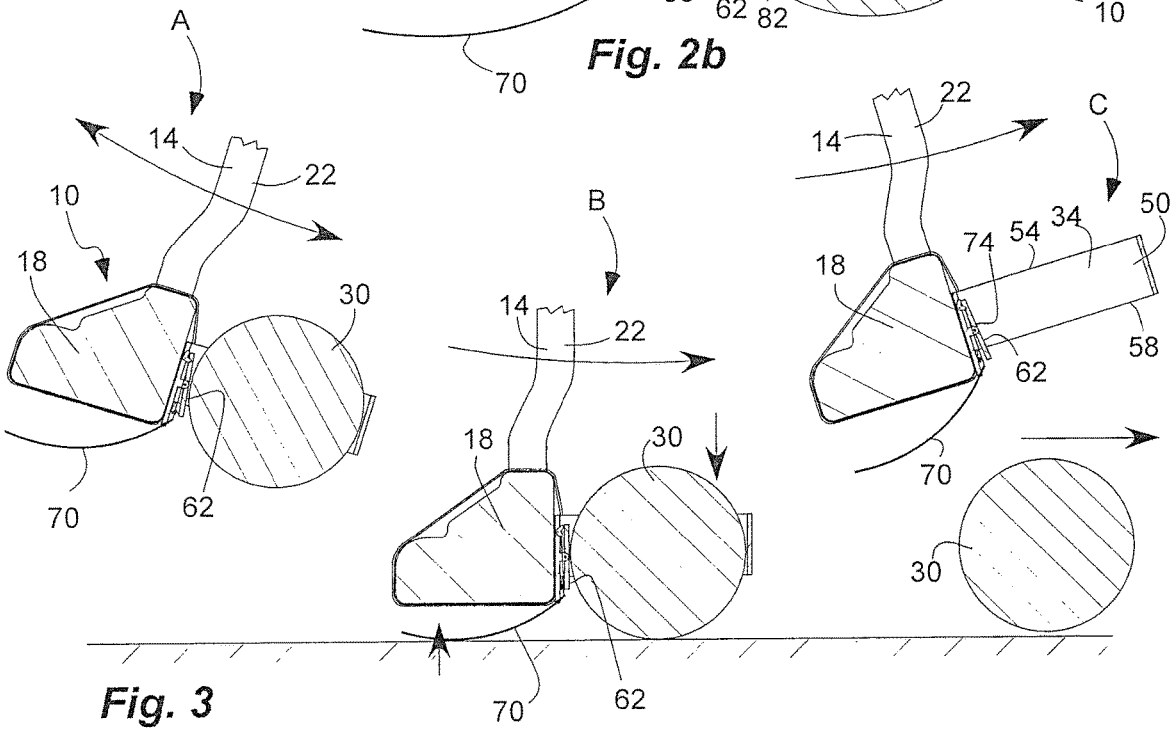
FIG. 3 is a cross-sectional side schematic view of the golf putting training aid of FIG. 1, shown moving through a back wing and a first portion of a fore swing with the golf ball retained in the aid, an intermediate position adjacent a green with the golf ball released onto the green and being pushed by a golf putter, and a remainder of the fore swing with the golf ball moving on the green.

Referring to FIGS. 1-3, a golf putting training aid 10 in accordance with an exemplary embodiment is shown for teaching a golfer to put by pushing the golf ball on the green with a putter towards the hole or cup. The aid 10 can comprise or can be carried by a distal end of a golf club shaft 14. The shaft 14 can have an opposite proximal end with a grip (not shown). In one aspect, the aid 10 can be a golf club with its own shaft. In another aspect, the aide 10 can be selectively and removably coupled to an existing putter head 18 of an existing putter 22. In either configuration, the club head 18 of the putter 22 or the aid 10 can comprise a forward facing surface or face 26 that can contact a golf ball 30. In one aspect, the face 26 can be provided by the aid 30. In another aspect, the face 26*b* can be provided by the putter 22.

The aid 10 comprises a collar 34 carriable by the golf club shaft 14. As described above, in one aspect, the collar 34 can be removably coupled to the putter head 18 on the shaft 14. In one aspect, the collar 34 can be defined by the head 18 of the putter 22, and an arc 38 of the collar 34. Thus, the head 18 and the aid 10 can together form the collar 34. In another aspect, the collar 34 can be formed without the head 18 of the putter 22. In one aspect, the collar 34 can have a pair of arms 42 extending from the collar. Fasteners 46, such as elastic bands or straps, can couple the pair of arms 42 to the putter head 18.

The collar 34 has a bore 50 extending substantially vertically through the collar 34. The bore 50 is sized to receive the golf ball 30 therein. In one aspect, the bore 50 can extend completely through the collar 34, as shown. Thus, the bore 50 can have a top opening 54 to receive the golf ball 30. In another aspect, the bore 50 can extend only partially through the collar 34 from the bottom. The bore 50 has a bottom opening 58 facing downwardly during use. The bottom opening 58 is sized to allow the golf ball 30 to pass therethrough. The collar 34 and the bore 50 can have a containment configuration with the golf ball 30 therein, and an empty configuration with the golf ball 30 deployed from the bore 50.

In one aspect, the collar 34 can be rigid. The collar 34 can be formed of plastic, and can be formed by injection molding. In another aspect, the collar 34 can be flexible and resilient, or elastic, and can comprise a loop that is flexible and resilient, or elastic, and capable of changing shape between the containment configuration with the golf ball 30 in the bore 50, and the empty configuration with the golf ball 30 deployed from the bore 50. Thus, the presence of the golf ball 30 can elastically deform the collar 34 or the loop and the bore 50. The elastic deformation of the collar 34 and the loop can help retain the golf ball 30 in the bore 50.

The aid 10 also comprises a flap 62 carried by the collar 34 and extending into the bore 50. The flap 62 can selectively retain and release the golf ball 30 with respect to the bore 50 and the collar 34. The flap 62 can be displaceable between two position, comprising: 1) an extended position (FIGS. 2*b* and 3 at A), and 2) a retracted position (FIG. 3 at B). In the extended position, the flap 62 extends into the bore 50 sufficient to resist the golf ball 30 from passing out of the bore 50 through the bottom opening 58. In the retracted position, the flap 62 is away from the bore 50 sufficient to allow the golf ball 30 to pass out of the bore 50 through the bottom opening 58. In one aspect, the flap 62 or a portion thereof can be positioned in the bore 50 below a midpoint of the golf ball 30 to reduce an effective diameter or size of the bore 50, less than a diameter of the golf ball 30, to retain the golf ball 30. In another aspect, the flap 62 can be pivotal with respect to the collar 34 and the bore 50 and can pivot about a pivot axis carried by the collar 34. The pivot axis can be located below the midpoint of the golf ball 30. The flap 62 can be biased towards the extended position by a spring 66.

In one aspect, the flap 34 can be positioned at a rear of the bore 50, and between the golf ball 30 and the head 18. Thus, the flap 34 can clamp the golf ball 30 between the flap 34 and the collar 34. In addition, the flap 34 can be oriented to face forwardly and towards the bore 50. In one aspect, the flap 34 can have a laterally straight leading edge and/or a flat face facing forwardly to contact the golf ball 30 and push the golf ball along the green when released, defining the face 26. Thus, in the retracted position (FIG. 3 at B), the flap 34 can release the golf ball 30 from the bore 50 through the bottom opening 58 and onto the green; and the flap 34, or face 26 thereof, can push the golf ball 30 along the green.

The aid 10 also comprises an automatic ground actuated trigger 70 operatively coupled to the flap 62 to displace or pivot the flap 62 from the extended position to the retracted position. The trigger 70 can be carried by the collar 34, and can extend downwardly and rearward during use. In one aspect, the trigger 70 can have a proximal end coupled to the collar 34 and a distal free end. In another aspect, the trigger 70 having a length and orientation to contact the ground during fore swing of the golf club shaft 14 (FIG. 3 at B) to displace the flap 62 to the retracted position. In another aspect, the trigger 70 can extend from the bore 50 to a location under and behind the bore 50, and beneath the putter head 18. In one aspect, the trigger 70 can extend in a broad arc, and can have a smooth lower contact surface to reduce catching or snagging on the green. In another aspect, the trigger 70 can be pivotal with respect to the collar 34, and can pivot about a pivot axis carried by the collar 34, defining a lever or lever arm. In one aspect, the trigger 70 can be displaceable upwardly by contact with the ground or green during fore swing (FIG. 3 at B). In one aspect, the trigger 70 can be relatively rigid, and can be formed by a wire or a band. In another aspect, the trigger 70 can be elastic, such as a leaf spring, to bend or flex upon contact with the green so as to reduce interference with the golfer's swing.

A linkage 74 can be coupled to and between the flap 62 and the trigger 70 to transfer pivotal movement of the trigger 70 to the flap 62. As described above, a spring 66 can engage the flap 62, and can bias the flap 62 to the extended position. The linkage 74 can comprise a cam 78 or lever, pivotal with respect to the flap 62, and engaging the flap 62 to pivot the flap 62 from the extended position to the retracted position. The cam 78 or lever can be carried by the collar 34. In addition, the linkage 74 can comprise a link 82, such as a line or cable, coupled to and between the trigger 70 and the cam 78. Pivotal motion of the trigger 70 pivots the cam 78, and thus the flap 62. The trigger 70 thus automatically operates by contact with the green during fore swing, when the putter head 18, the collar 34 and the golf ball 30 are adjacent the green, to displace or pivot the flap 62 to release the golf ball 30 from the bore 50 through the bottom opening 58 and onto the green, without any action on the part of the golfer, thus maintaining the golfer's focus on his or her swing and pushing the golf ball 30 on the green. In addition, the aid 10 provides a gravity feed with the trigger 70 operating to release the golf ball 30 by gravity only through the bottom opening 58 in front of the putter head 18, and without imparting any other force or direction to interfere with the golfer's training.

Figure 4:
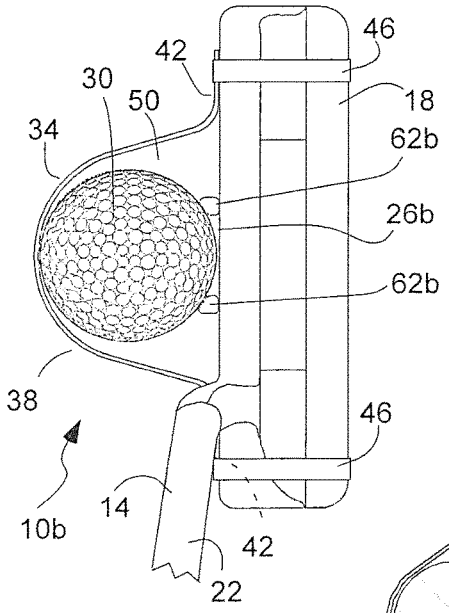
FIG. 4 is a top schematic view of another golf putting aid in accordance with another embodiment of the invention, shown with the golf ball retained in the aid.
Figure 5:
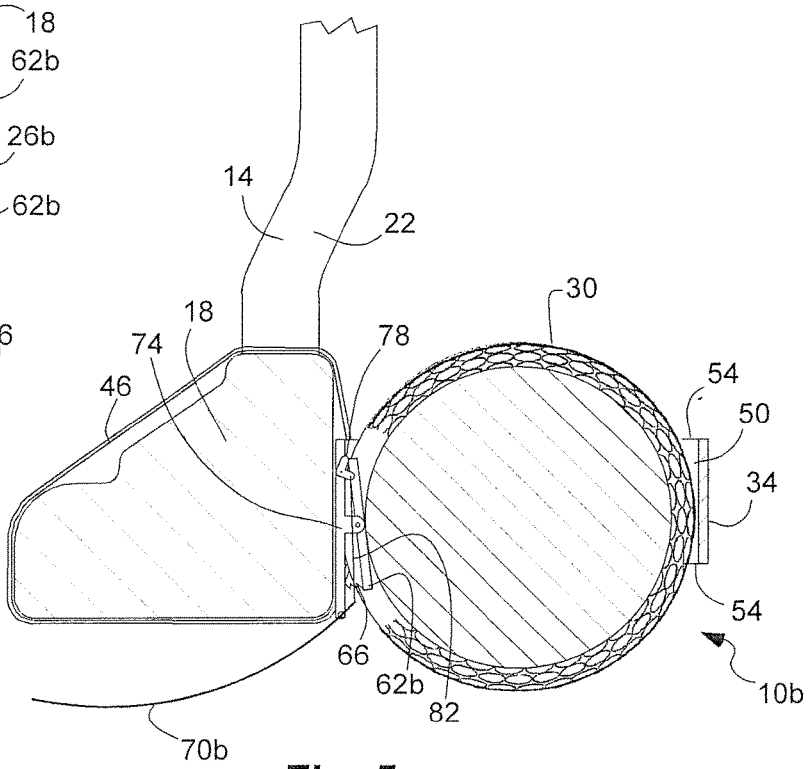
FIG. 5 is a cross-sectional side schematic view of the golf putting training aid of FIG. 4, shown with the gold ball retained in the aid.

Referring to FIGS. 4 and 5, another golf putting training aid 10*b* is shown that is similar to that described above in many respects, and which description is hereby incorporated herein by reference. The flap 62*b* can comprise a single flap 62*b*, or a pair of flaps 62*b*, located laterally off-center from the bore 50, and thus the golf ball 30, as shown in FIG. 4. Similarly, the trigger 70*b* can comprise a single trigger 70*b* corresponding to the single flap 62*b*, or a pair a triggers 70*b* corresponding to the pair of flaps 62*b*. Positioning the flap(s) 62*b* laterally allows the collar 34, or the putter head 18, to provide the laterally straight leading edge or face 26*b* for facing the bore 50 and contacting the golf ball 30 and pushing the golf ball along the green. The face 26*b* may provide a more stable surface for pushing the golf ball 30. In addition, the face 26*b* can be the face of the existing putter head 18 to allow the golfer to experience the feel of his or her own club.

Figure 6:
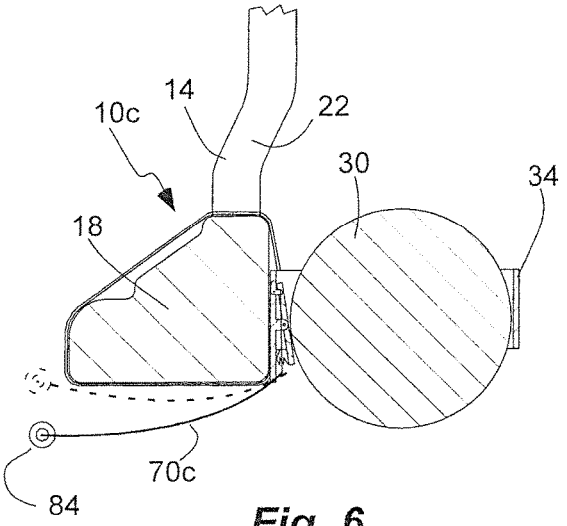
FIG. 6 is a cross-sectional side schematic view of another golf putting aid in accordance with another embodiment of the invention, shown with the golf ball retained in the aid.

Referring to FIG. 6, another golf putting training aid 10*c* is shown that is similar to those described above in many respect, and which description is hereby incorporated herein by reference. The trigger 70*c* can comprise a roller 84 or a wheel disposed on a distal free end of thereof to reduce frictional contact with the green and further provide a natural feel for the putter 22 during fore swing.

Figure 7:
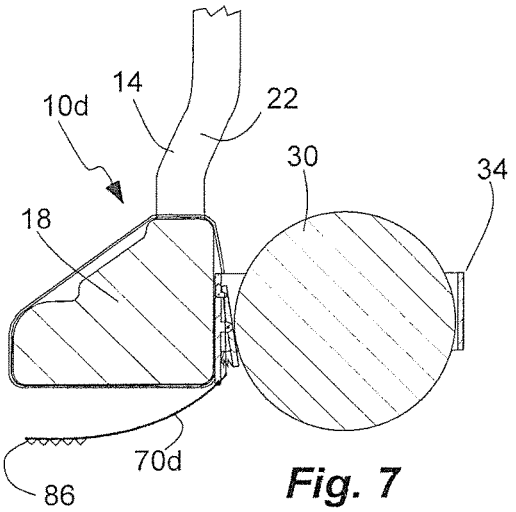
FIG. 7 is a cross-sectional side schematic view of another golf putting aid in accordance with another embodiment of the invention, shown with the golf ball retained in the aid.

Referring to FIG. 7, another golf putting training aid 10*d* is shown that is similar to those described above in many respects, and which description is hereby incorporated herein by reference. The trigger 70*d* can comprise a catch 86 disposed on a distal free end of thereof to contact and engage the green and insure that the trigger 70*d* is engaged. The catch 86 can comprise a tooth or teeth.

Figure 8:
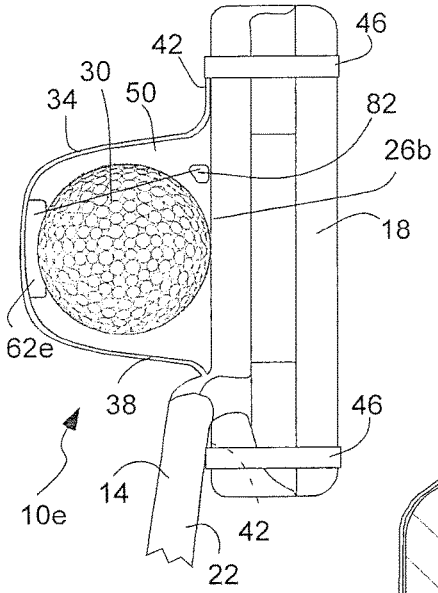
FIG. 8 is a top schematic view of another golf putting aid in accordance with another embodiment of the invention, shown with the golf ball retained in the aid.
Figure 9:
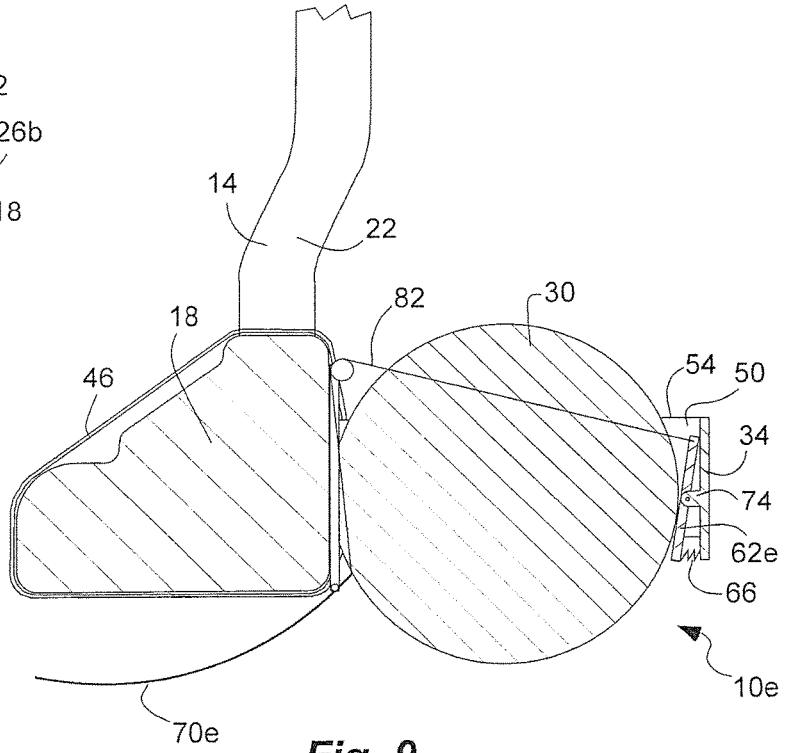
FIG. 9 is a cross-sectional side schematic view of the golf putting training aid of FIG. 8, shown with the gold ball retained in the aid.

Referring to FIGS. 8 and 9, another golf putting training aid 10*e* is shown that is similar to those described above in many respects, and which description is hereby incorporated herein by reference. The flap 62*e* is located at a front of the bore 50. Positioning the flap 62*e* forwardly allows the collar 34, or the putter head 18, to provide the laterally straight leading edge or face 26*b* for facing the bore 50 and contacting the golf ball 30 and pushing the golf ball along the green. The face 26*b* may provide a more stable surface for pushing the golf ball 30. The trigger 70*e* can be positioned rearward or aft of the bore 50 while the flap 62*e* is positioned forward of the bore 50. The link 82 can comprise a cable and the linkage 74 can comprise a pulley to couple the trigger 70*e* and the flap 62*e*. In addition, the face 26*b* can be the face of the existing putter head 18 to allow the golfer to experience the feel of his or her own club.

Figure 11:
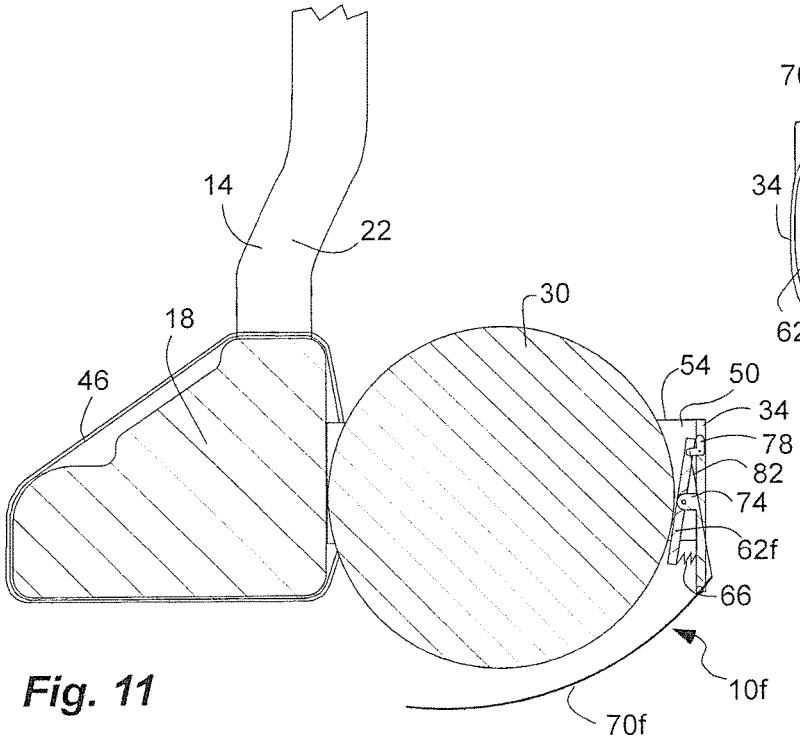
FIG. 11 is a cross-sectional side schematic view of the golf putting training aid of FIG. 10, shown with the gold ball retained in the aid.
Figure 10:
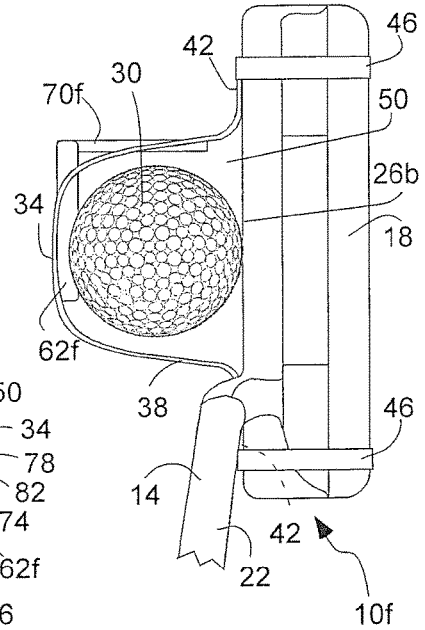
FIG. 10 is a top schematic view of another golf putting aid in accordance with another embodiment of the invention, shown with the golf ball retained in the aid.

Referring to FIGS. 10 and 11, another golf putting training aid 10*f* is shown that is similar to those described above in many respects, and which description is hereby incorporated herein by reference. The flap 62*f* is located at a front of the bore 50. In addition, the trigger 70*f* is carried by a front of the collar 34. Positioning the flap 62*f* forwardly allows the collar 34, or the putter head 18, to provide the laterally straight leading edge or face 26*b* for facing the bore 50 and contacting the golf ball 30 and pushing the golf ball along the green. The face 26*b* may provide a more stable surface for pushing the golf ball 30. In addition, the face 26*b* can be the face of the existing putter head 18 to allow the golfer to experience the feel of his or her own club. Positioning the trigger 70*f* forwardly can reduce the linkage 74*f* from extending across the bore 50. The trigger 70*f* can be positioned laterally off-center and lateral of the bore 50 to resist interference with the golf ball 30.

Figure 12:
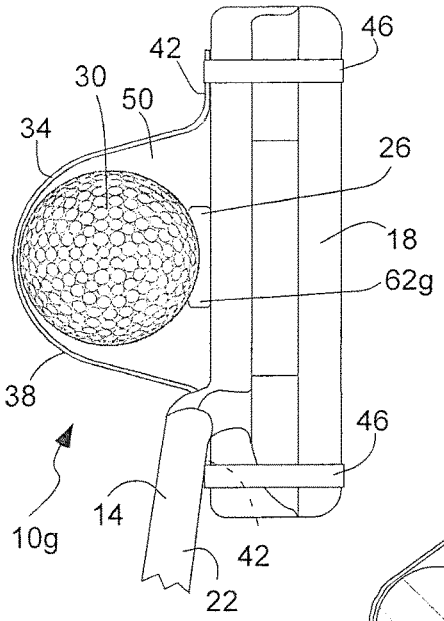
FIG. 12 is a top schematic view of another golf putting aid in accordance with another embodiment of the invention, shown with the golf ball retained in the aid.
Figure 13:
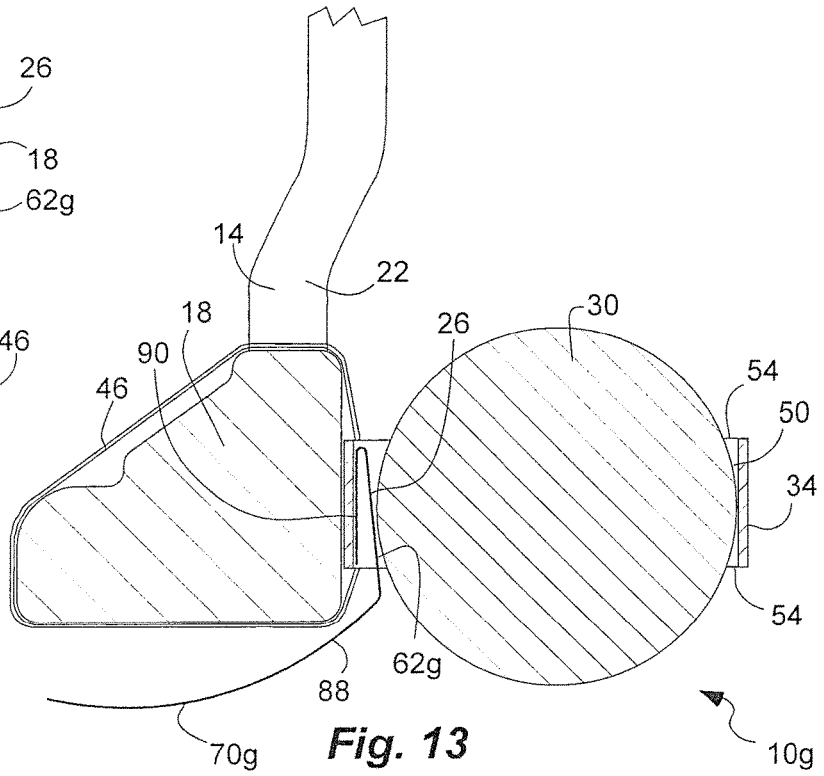
FIG. 13 is a cross-sectional side schematic view of the golf putting training aid of FIG. 12, shown with the gold ball retained in the aid.

Referring to FIGS. 12 and 13, another golf putting training aid 10*g* is shown that is similar to those described above in many respects, and which description is hereby incorporated herein by reference. The flap 62*g* and the trigger 70*g* can be formed together as a single, continuous member or spline 88. The member or spline 88 can be flexible and resilient, or elastic, defining a leaf spring. In addition, the member or spline 88 or leaf spring can have an attachment tab 90 forming part of the spline and attached to the collar 34. The trigger 70*g* or spline 88 can be positioned laterally off-center and lateral of the bore 50 to resist interference with the golf ball 30. In one aspect, the trigger 70*g* and the flap 62*g* are displaceable rearward as the trigger 70*g* contacts with the ground or green during fore swing. In addition, the trigger 70*g* can be displaceable both upwardly and rearward by contact with the ground or green during fore swing. The spline 88 can extend upwardly through the tab 90, through substantially a 360 degree turn or elbow, downwardly and forwardly through the flap 62*h*, through substantially a 90 degree turn or elbow, and downwardly and rearward through the trigger 70*h*. The trigger 70*h* can have a substantially broad arc. In one aspect, the spline 88 can be flexible and resilient, or elastic, like a leaf spring. In another aspect, the spline 88 can be formed of metal bent into shape. In another aspect, the spline 88 can be formed of plastic.

Figure 15:
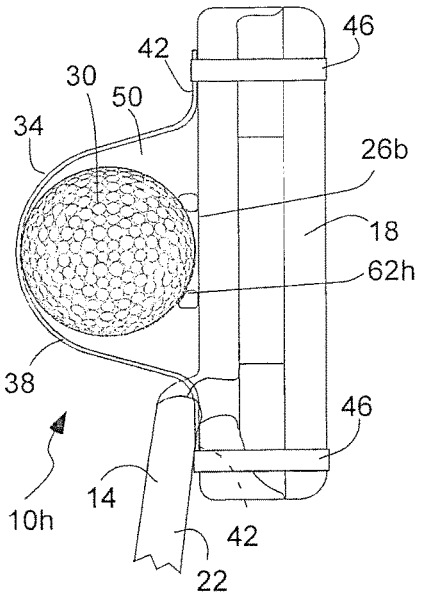
FIG. 15 is a top schematic view of another golf putting aid in accordance with another embodiment of the invention, shown with the golf ball retained in the aid.
Figure 16:
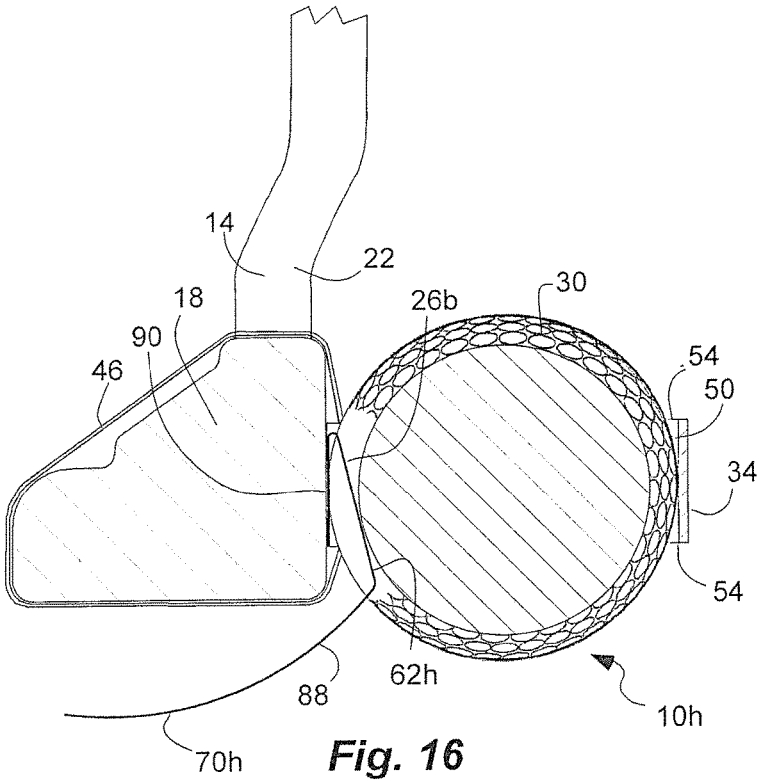
FIG. 16 is a cross-sectional side schematic view of the golf putting training aid of FIG. 15, shown with the gold ball retained in the aid.

Referring to FIGS. 15 and 16, another golf putting training aid 10*h* is shown that is similar to those described above in many respects, and which description is hereby incorporated herein by reference. The flap 62*h* can comprise a single flap 62*h*, or a pair of flaps 62*h*, located laterally off-center from the bore 50, and thus the golf ball 30. Similarly, the trigger 70*h* can comprise a single trigger 70*h* corresponding to the single flap 62*h*, or a pair a triggers 70*h* corresponding to the pair of flaps 62*h*. Thus, the spline can be a single spline or a pair of splines located laterally off-center from the bore 50. Positioning the flap(s) 62*h* or the spline(s) laterally allows the collar 34, or the putter head 18, to provide the laterally straight leading edge or face 26*b* for facing the bore 50 and contacting the golf ball 30 and pushing the golf ball along the green. The face 26*b* may provide a more stable surface for pushing the golf ball 30. In addition, the face 26*b* can be the face of the existing putter head 18 to allow the golfer to experience the feel of his or her own club.

Figure 17:
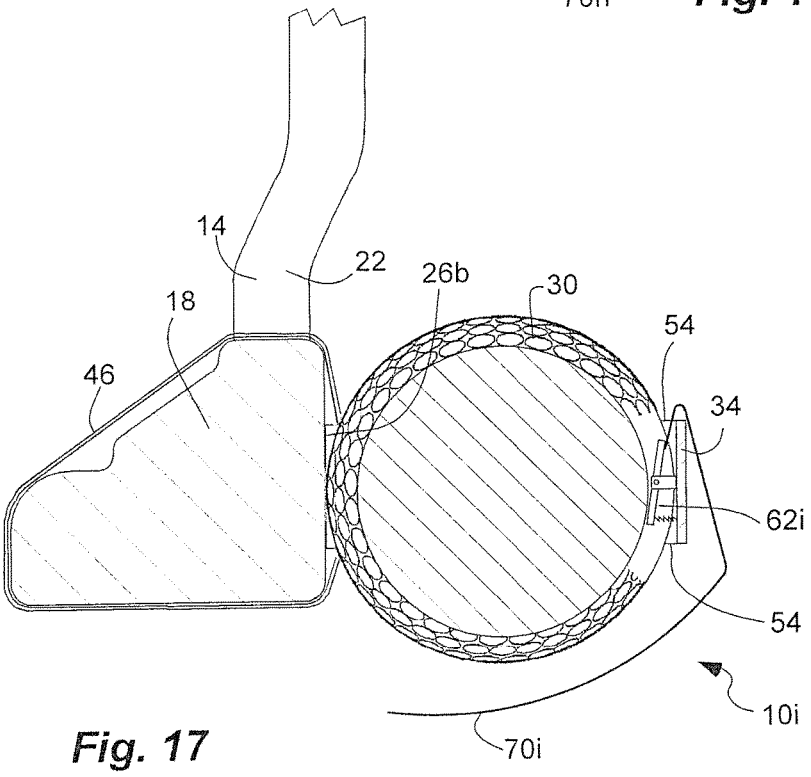
FIG. 17 is a cross-sectional side schematic view of another golf putting aid in accordance with another embodiment of the invention, shown with the golf ball retained in the aid.

Referring to FIG. 17, another golf putting training aid 10*i* is shown that is similar to those described above in many respects, and which description is hereby incorporated herein by reference. The flap 62*i* is located at a front of the bore 50. In addition, the trigger 70*i* is carried by a front of the collar 34. The trigger 70*i* can be positioned laterally off-set from the bore 30 so as not to interfere with the golf ball 30 being dropped from the bottom opening 58. Positioning the flap 62*i* forwardly allows the collar 34, or the putter head 18, to provide the laterally straight leading edge or face 26*b* for facing the bore 50 and contacting the golf ball 30 and pushing the golf ball along the green. The face 26*b* may provide a more stable surface for pushing the golf ball 30. In addition, the face 26*b* can be the face of the existing putter head 18 to allow the golfer to experience the feel of his or her own club. Positioning the trigger 70*f* forwardly can reduce the linkage 74*f* from extending across the bore 50.

Figure 18:
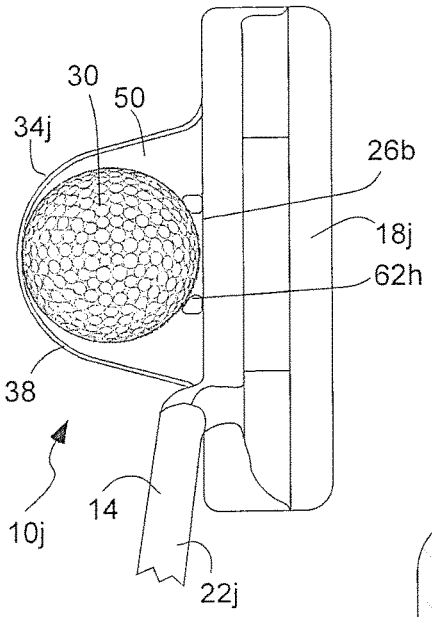
FIG. 18 is a top schematic view of another golf putting aid in accordance with another embodiment of the invention, shown with the golf ball retained in the aid.
Figure 19:
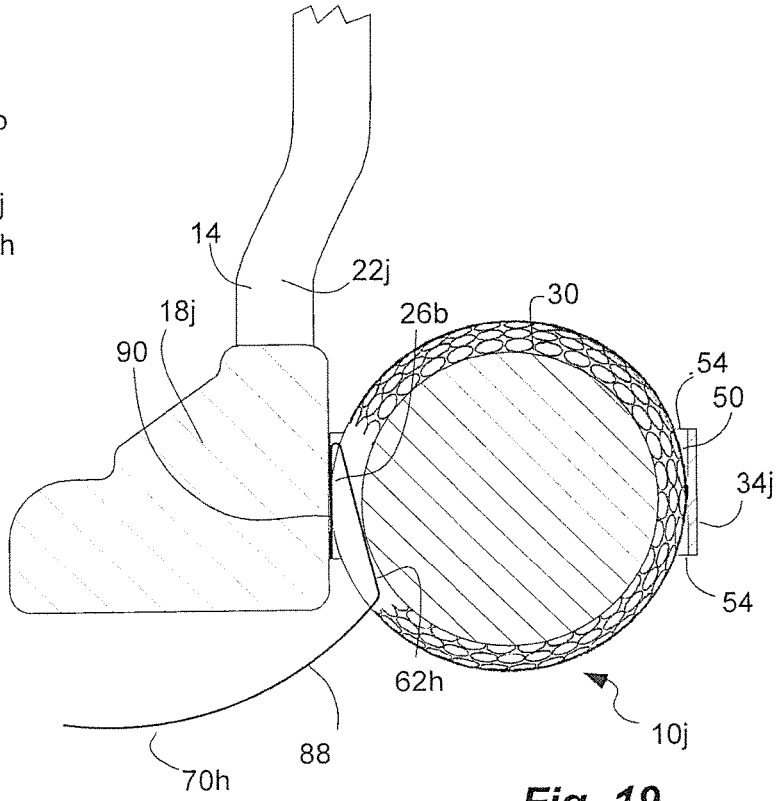
FIG. 19 is a cross-sectional side schematic view of the golf putting training aid of FIG. 18, shown with the gold ball retained in the aid.

Referring to FIGS. 18 and 19, another golf putting training aid 10*j* is shown that is similar to those described above in many respects, and which description is hereby incorporated herein by reference. The aid 10*j* is combined with the putter 22*j* or club as a dedicated training club or aid. The collar 34*j* is part of the putter 22*j* and the putter head 18*j*.

Figure 14:
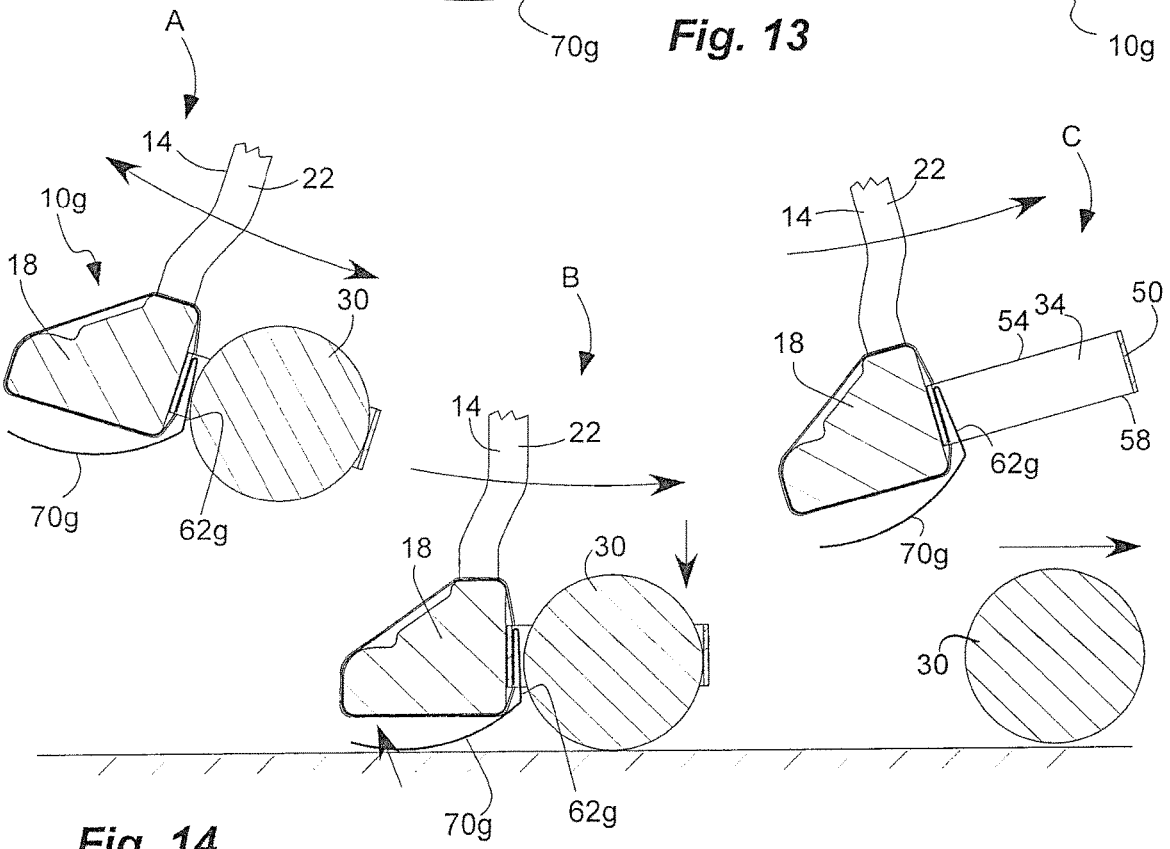
FIG. 14 is a cross-sectional side schematic view of the golf putting training aid of FIG. 12, shown moving through a back wing and a first portion of a fore swing with the golf ball retained in the aid, an intermediate position adjacent a green with the golf ball released onto the green and being pushed by a golf putter, and a remainder of the fore swing with the golf ball moving on the green.

A method for training to put and for utilizing the golf putter training aid in any embodiment described above (represented by 10) comprises:

a placing the golf ball 30 in the bore 50 of the collar 34;

positioning the putter head 18 and the collar 34 with the golf ball 30 therein adjacent the ground or the green;

carrying the golf ball 30 in the collar 34 through a back swing (FIGS. 3 and 14 at A);

carrying the golf ball 30 in the collar 34 partially through a fore swing (FIGS. 3 and 14 at B);

contacting the ground or the green with the trigger 70 midway through the fore swing to release the golf ball 30 from the bore 50 of the collar 34 to the ground or the green (FIGS. 3 and 14 at B);

continuing the fore swing while pushing the golf ball 30 along the ground or the green with the face 26 of the collar 34 or the face 26*b* of the putter head 18 of the putter 22 (FIGS. 3 and 14 at B); and continuing the fore swing while the putter head 18 raises from the golf ball 30 (FIGS. 3 and 14 at C).

It is to be understood that the examples set forth herein are not limited to the particular structures, process steps, or materials disclosed, but are extended to equivalents thereof as would be recognized by those ordinarily skilled in the relevant arts. It should also be understood that terminology employed herein is used for the purpose of describing particular examples only and is not intended to be limiting.

Furthermore, the described features, structures, or characteristics may be combined in any suitable manner in one or more examples. In the description, numerous specific details are provided, such as examples of lengths, widths, shapes, etc., to provide a thorough understanding of the technology being described. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the invention in one or more particular applications, it will be apparent to those of ordinary skill in the art that numerous modifications in form, usage and details of implementation can be made without the exercise of inventive faculty, and without departing from the principles and concepts described herein. Accordingly, it is not intended that the invention be limited, except as by the claims set forth below.

What is claimed is:

1. A golf putting training aid device, comprising:

a) a collar carriable by a golf club shaft;

b) the collar having a bore extending vertically in the collar and sized to receive a golf ball therein;

c) the bore having a bottom opening facing downwardly during use;

d) a flap carried by the collar and extending into the bore to selectively retain and release the golf ball with respect to the bore, the flap being displaceable between two positions, comprising:

i) an extended position extending into the bore sufficient to resist the golf ball from passing out of the bore through the bottom opening; and ii) a retracted position away from the bore sufficient to allow the golf ball to pass out of the bore through the bottom opening;

e) an automatic ground actuated trigger coupled to the flap and extending downwardly and rearward with respect to the collar, the trigger being displaceable between two positions, comprising:

i) an actuated position displaced upward by contact with the ground during fore swing of the golf club shaft to displace the flap to the retracted position and release the golf ball through the bottom opening; and ii) an un-actuated position free of contact with the ground and corresponding to the extended position of the flap to resist the golf ball from passing out of the bore through the bottom opening; and f) a majority of the trigger remaining outside of the bore in both the actuated and un-actuated positions.

2. The device in accordance with claim 1, wherein the flap is positioned at a rear of the bore and oriented to face forwardly, and wherein the flap has a laterally straight leading edge facing forwardly and configured to contact the golf ball.

3. The device in accordance with claim 1, wherein the flap is located laterally off-center from the bore, and wherein the collar has a laterally straight leading edge facing the bore and configured to contact the golf ball.

4. The device in accordance with claim 1, wherein the collar comprises a loop that is flexible and capable of changing shape between a containment configuration with the golf ball in the bore, and an empty configuration with the golf ball deployed from the bore.

5. The device in accordance with claim 1, further comprising:

the flap being pivotal with respect to the collar;

the trigger being pivotal with respect to the collar;

a linkage coupled to and between the flap and the trigger to transfer pivotal movement of the trigger to the flap.

6. The device in accordance with claim 1, further comprising:

the flap being pivotal with respect to the collar;

the trigger being pivotal with respect to the collar;

a spring engaging the flap and biasing the flap to the extended position;

a cam pivotal with respect to the flap and engaging the flap to pivot the flap from the extended position to the retracted position; and a link coupled to and between the trigger and the cam with pivotal motion of the trigger pivoting the cam, and thus the flap.

7. The device in accordance with claim 1, wherein the flap and the trigger form a continuous spline.

8. The device in accordance with claim 7, wherein the spline is flexible and resilient defining a leaf spring.

9. The device in accordance with claim 7, further comprising:

an attachment tab forming part of the spline and attached to the collar, the spline extending upwardly through the tab, through substantially a 360 degree turn, downwardly and forwardly through the flap, through substantially a 90 degree turn, and downwardly and rearward through the trigger.

10. The device in accordance with claim 1, wherein the flap is located at a front of the bore, and wherein the collar has a laterally straight edge facing the bore and configured to contact the golf ball.

11. The device in accordance with claim 1, wherein the collar is removably coupled to a putter head on the golf club shaft, the device further comprising:

a pair of arms extending from the collar and fasteners coupling the pair of arms to the putter head.

12. The device in accordance with claim 1, wherein the collar is defined by a head of a putter and an arc of the collar.

13. The device in accordance with claim 1, wherein trigger extends from the bore to a location under and behind the bore.

14. The device in accordance with claim 1, wherein trigger further comprises a roller disposed on a distal free end of thereof.

15. The device in accordance with claim 1, wherein the collar and the flap are capable of carrying the golf ball through a back swing and an initial portion of a fore swing of the golf club shaft.

16. The device in accordance with claim 1, wherein the trigger has a distal free end that remains under and behind the bore.

17. The device in accordance with claim 1, wherein the trigger extends below the collar in a broad arc under and behind the bore.

18. A golf putting training aid device, comprising:

a) a collar carriable by a golf club shaft;

b) the collar having a bore extending vertically in the collar and sized to receive a golf ball therein;

c) the bore having a bottom opening facing downwardly during use;

d) a flap carried by the collar and extending into the bore to selectively retain and release the golf ball with respect to the bore, the flap being displaceable to allow the golf ball to pass out of the bore through the bottom opening; and e) an automatic ground actuated trigger carried by the collar, operatively coupled to the flap, and extending down and rearward with respect to the collar, the trigger having an actuated position displaced upwardly by contact with the ground during fore swing of the golf club shaft to displace the flap to the retracted position and release the golf ball under gravity through the bottom opening.

19. The device in accordance with claim 18, wherein the trigger has a distal free end that remains under and behind the bore.

20. A method for training to put in golf, the method comprising:

a placing a golf ball in a bore of a collar carried by a golf club shaft, the bore having a bottom opening facing downwardly;

positioning the collar with the golf ball therein adjacent the ground;

carrying the golf ball in the collar through a back swing, the collar having a flap positioned to extend into the bore sufficient to resist the golf ball from passing out of the bore through the bottom opening during the back swing;

carrying the golf ball in the collar partially through a fore swing;

contacting the ground with an automatic ground contact trigger midway through the fore swing, displacing the trigger upwardly to retract the flap away from the bore sufficient to release the ball from the bore of the collar and through the bottom opening to the ground; and continuing the fore swing while pushing the golf ball along the ground.

* * * * *